US005845355A

United States Patent [19]

Strahm

[11] Patent Number: 5,845,355

[45] Date of Patent: Dec. 8, 1998

[54] METHOD AND DEVICE FOR FIBRILLATING CELLULOSE FIBERS THAT PERMIT EASY FIBRILLATION, IN PARTICULAR TENCEL FIBERS

[75] Inventor: Christian Strahm, Bronschhofen, Switzerland

[73] Assignee: Solipat AG, Zug, Switzerland

[21] Appl. No.: 840,461

[22] Filed: Apr. 18, 1997

[30] Foreign Application Priority Data

May 8, 1996 [CH] Switzerland ..... 1173/96

[51] Int. Cl.[6] ..... D06B 3/28; D06C 19/00

[52] U.S. Cl. ..... 8/152; 68/178; 26/21; 26/27

[58] Field of Search ..... 8/152, 151, 158; 68/177, 178, 179, 13 R, 38; 28/167; 26/19, 20, 21, 27, 18.5, 18.6

[56] References Cited

U.S. PATENT DOCUMENTS

| | | | |
|---|---|---|---|
| 3,593,546 | 7/1971 | Hasegawa | 68/178 |
| 3,626,449 | 12/1971 | Arashi | 26/19 |
| 4,291,442 | 9/1981 | Marco . | |
| 4,578,085 | 3/1986 | Ishimaru | 8/152 |
| 4,607,409 | 8/1986 | Hishimuma et al. | 8/152 |
| 5,274,892 | 1/1994 | Strahm | 26/20 |
| 5,309,613 | 5/1994 | Strahm | 26/27 |
| 5,349,711 | 9/1994 | Iwami | 8/152 |
| 5,431,031 | 7/1995 | Vinas | 68/178 |
| 5,623,738 | 4/1997 | Biancalani et al. | 8/152 |
| 5,678,429 | 10/1997 | Zonco | 26/21 |

FOREIGN PATENT DOCUMENTS

| | | |
|---|---|---|
| 535 287 | 10/1991 | European Pat. Off. . |
| 1298273 | 12/1989 | Japan . |
| 7011566 | 1/1995 | Japan . |

OTHER PUBLICATIONS

Chemiefaser/Textilindustrie, Bd. 44 Nr. 96.

*Primary Examiner*—Amy Vanatta
*Attorney, Agent, or Firm*—Shoemaker and Mattare, Ltd.

[57] ABSTRACT

A method and a device for fibrillating cellulose fibers contained in a fabric web (3) comprise the fabric web (3) being withdrawn from a fabric storage chamber (6), accelerated through a guide slot by means of liquid flowing at high speed and then flung against a rebound surface (13). The fabric web can be transported alternatingly in both directions through the guide slot (7) and flung onto the first rebound surface (13) and a second rebound surface (16).

5 Claims, 3 Drawing Sheets

Figure 1:
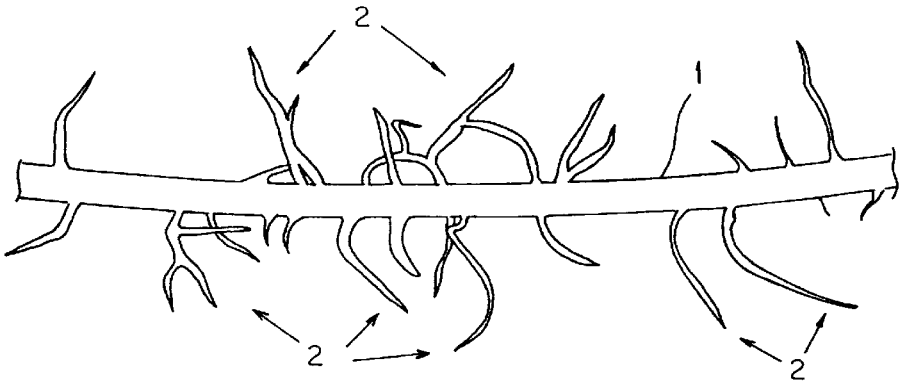

METHOD AND DEVICE FOR FIBRILLATING CELLULOSE FIBERS THAT PERMIT EASY FIBRILLATION, IN PARTICULAR TENCEL FIBERS

The invention concerns a method and a device according to the preamble of the independent patent claims.

Cellulose fibres that permit fibrillation, in particular Lyocell fibers (such as tencel fibers), enjoy increasing popularity on account of their good properties with regard to wearing and color, as well as a plurality of finishing options and methods for influencing the "feel".

"Lyocell" fibers are cellulose fibers manufactured by means of a solvent-spinning process, the outer jacket of which can be mechanically split so that fibrils protrude from the surface of said jacket. In the case of lyocell fibers, it is normal to induce fibrillation in a strand (hank) treatment. Factors which can influence the tendency to fibrillate are mainly: pH value, temperature, and the effect of mechanical action. Apart from that, cellulase enzymes are frequently employed to promote fibrillation. Cellulase enzymes are proteins capable of breaking down cellulose. A cellulase enzyme comprises a plurality of different enzyme components. The 4 most important are: endocellulase, exocellulase, cellobiohydrolase and cellobiase. The action of exocellulase results in soluble glucose direct from cellulose. The other components systematically attack the cellulose chains, in that they randomly split the formation of cellobiose into soluble glucose.

Theoretically, the fibrillation of lyocell fibers can also be induced by means of mechanical treatment alone, and in particular by wet friction. The addition of enzymes serves to additionally promote and control the process. Apart from that, enzyme processes are employed to weaken and remove the lomg fibrils after an initial fibrillisation. This sequence is extensively described in "ITB Veredlung, 2/94", p. 5; R. Breier, "Veredlung von Lycell Fasern, Chemiefasern/Textilindustrie, 44./96". Date November/-December 1994, p. 812; "Lyocell-Fasern: Herstellung, Eigenschaften, Einsatzgebiete in Chemiefasern/Textilindustrie, 43./95". Date, October 1993, p. 745; I Marini, Lenzing "Lyocell-Fasern in Chemiefasern/Textilindustrie, 43./95". Date, November 1993, p. 878.

In practice, the fibrillation is mostly induced in strand (hank) treatment, and carried out intermittently. State-of-the-art fibrillation methods demand treatment lasting many hours. Conversely, in the case of the classic form of finish of tencel fabric ("open-width" treatment), hitherto it has been assumed that no fibrillation occurs.

The invention nevertheless proposes carrying out, with open-width fabric, fibrillation of cellulose fibers that permit fibrillation, such as lycocell, and in particular of flat textile substrates containing tencel fibers. According to the invention, this can be attained if the open-width fabric web is impinged upon by a flow of liquid flowing at high speed and is accelerated by said flow and flung against a rebound surface along with said flow of liquid, and if the acceleration and flinging sequence is repeated for a sufficient number of times until the surface area of the fibers is split and fibrils form.

Fibrillation can be influenced according to the state of the art by enzyme treatment, temperature, and adjustment of pH value. The invention can be employed for primary fibrillation of the fabric and, for example, in a subsequent enzyme process to remove the long fibrils by means of enzyme treatment according to the state of the art. The method according to the invention can also be employed for secondary fibrillation, in other words, therefore, for a fibrillation process subsequent to an initial fibrillation, a subsequent treatment for shortening of the long fibrils and, if necessary, other finishing steps.

It is particularly advantageous if the fabric web is collected in a fabric storage chamber and is withdrawn from said storage chamber by means of the liquid, said liquid flowing at high velocity. The fabric, lying loosely in such a fabric storage chamber, can be carried along and accelerated particularly well by means of the liquid flowing at high-velocity.

It is further of particular advantage if the fabric web is sequentially carried along in the opposite direction by such a liquid flow, and flung against rebound surfaces. It is thus conceivable, for example, to transport the open-width fabric, guided within a slot, by means of the liquid, fling said fabric against a rebound surface, collect the fabric in a storage chamber, and then reverse the direction of liquid flow and accelerate the fabric in the opposite direction through the slot, and fling it against a rebound surface arranged on the other side of the slot, and to collect the fabric there in a fabric storage chamber. The fabric would thus alternatingly be transported "forwards and backwards" through the guide slot. If, at the same time, the duration of transport in the "forwards" direction is longer than the duration of transport in the opposite direction, a resultant "forwards" transport will arise. For example, transport in one direction can be for 6 seconds, followed by a switchover, followed by transport in the opposite direction for 5 seconds only. Subsequently, transport is again for 6 seconds in the forwards direction, and five seconds backwards, and so on. With that, the fabric passes through approximately 10 acceleration phases, in each case being flung against a rebound baffle.

Specifically recommendable in this regard is the arrangement of two fabric storage chambers in which, in each case, the fabric is loosely collected after having been flung against a rebound surface. The appropriate and desired partial amounts can be transported away from such a fabric storage chamber, while the remaining fabric is once more available for a further treatment cycle, in other words, acceleration in the opposite direction.

These types of treatment systems with alternating acceleration and flinging of the fabric against rebound surfaces lead to particularly good feel characteristics. However, it would of course also be conceivable to transport the fabric through an arrangement in one direction only and then, after treatment of the desired amount of fabric, to repeat the sequence in the opposite direction.

Particularly good results can be aimed at if the fabric web is accelerated with a speed of at least 8 meters per second, preferably at a speed of 9 meters per second to 15 metres per second.

This can mainly be attained if the speed of the liquid jet (preferably a jet of water) within the transport slot amounts to approximately 12 to 20 meters per second, and preferably approximately 15 meters per second.

The method according to the invention for fibrillation of cellulose fibers contained in a textile web, in particular lyocell fibers (such as tencell fibers) can be carried out with particular advantage with a device wherein the fabric web, guided in open-width, is accelerated within a guide slot, said guide slot being subjected to through flow by a liquid, if the guide slot is bordered by a nozzle element at least on one side, said nozzle element possessing a feed channel for the liquid and, on two opposing sides, an outlet slot narrowing towards the guide slot, as well as a valve element for alternating closure of one of the outlet slots.

Particularly uniform and good acceleration values can be attained if outlet slots are provided for the liquid in both surfaces of the guide slot, so that the fabric is subjected to acceleration by means of the liquid both on its upper side and on its lower side.

Instead of one outlet slot for the liquid, a plurality of outlet slots can naturally also be provided insofar as said arrangement is accompanied by favorable values from the flow point of view. In practice, it has been shown to be particularly successful if each outlet slot tapers towards the guide slot, and if the axis of flow of the outlet slot is inclined at an angle $\alpha$ of approximately 10° to 20°, preferably of approximately 15°, to the plane of the guide slot.

Figure 2:
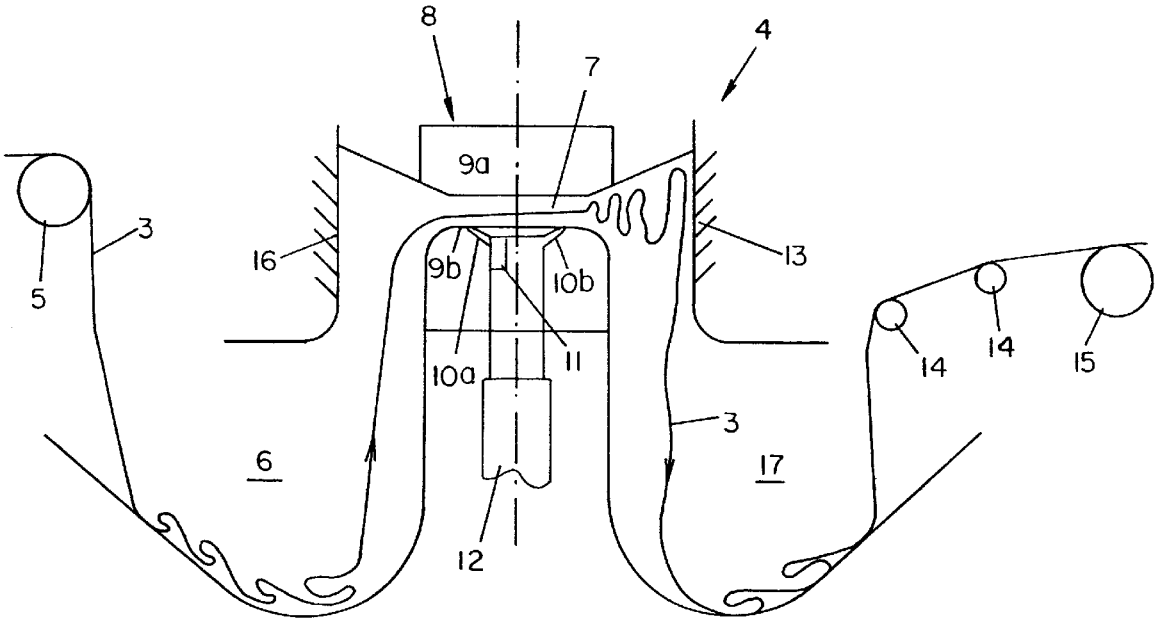
Figure 3:
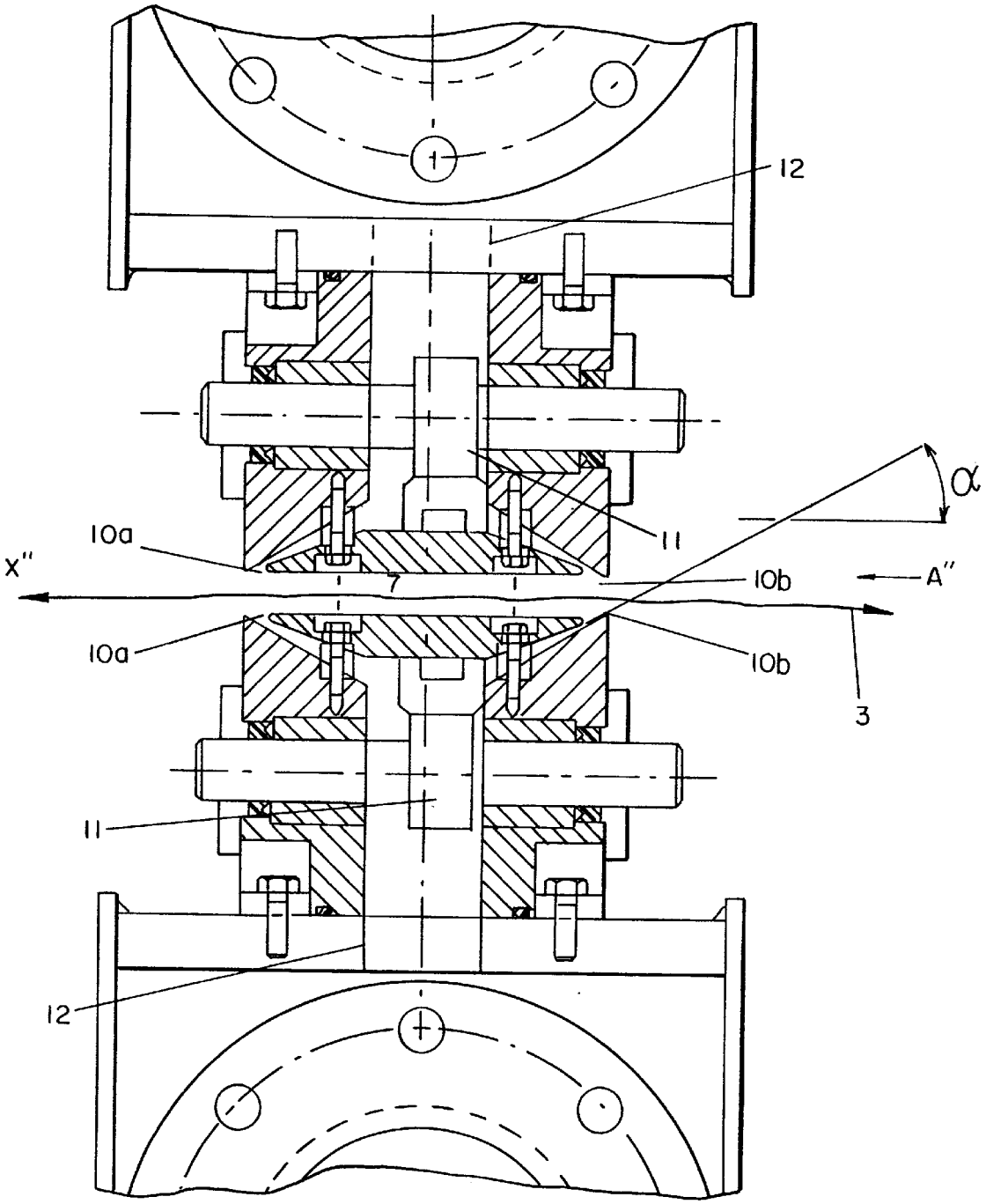
Figure 4:
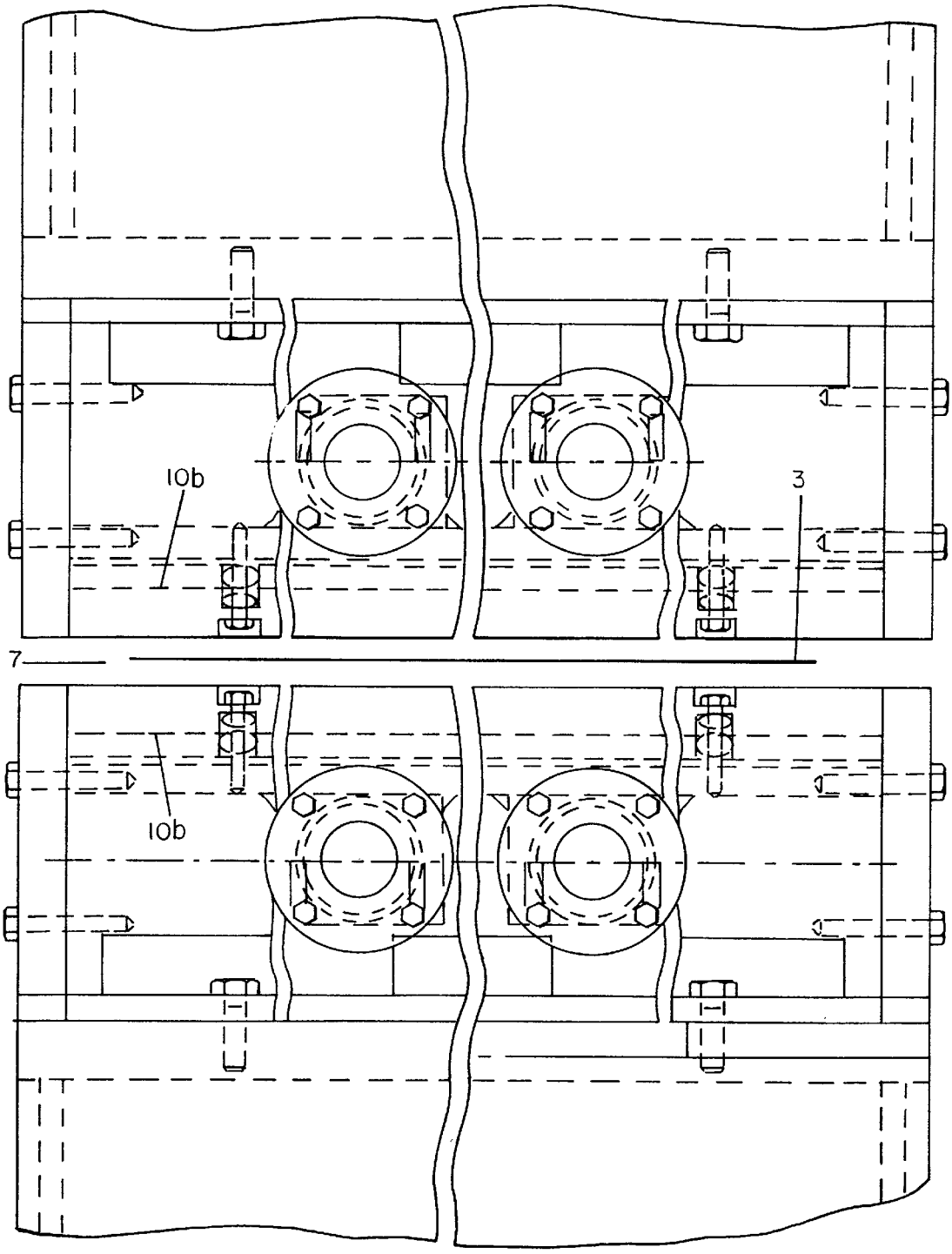

Embodiments of the invention are more closely explained in the following, with the aid of the drawings: namely, FIG. 1 A schematic representation of a fibrillated tencel fiber serving as an example of a fibrillated cellulose fiber;

FIG. 2 a schematic representation of a fabric run possessing the features of the invention;

FIG. 3 a sectional representation through a guide slot, said slot serving to accelerate the fabric web, possessing the features of the invention; and FIG. 4 a detail representation of the guide slot according to FIG. 3, viewed from the direction "A" as shown in FIG. 3.

FIG. 1 shows schematically a tencel fiber 1, from which fibrils 2 protrude. The tencel fiber 1 is a component of a weave, not shown more closely here, that has been subjected to a treatment according to the invention.

As shown schematically in FIG. 2, a fabric web 3 is fed to a fibrillation device 4 via a transport roller 5 by means of transport equipment that is not shown more closely in this case. The transport roller 5 continuously transports the fabric web into a fabric storage chamber 6. From there, the fabric web 3 passes through the guide slot 7 of an acceleration device 8.

The guide slot 7 is bordered by an upper and a lower guideway 9*a* and 9*b*. Two outlet slots 10 are provided in the lower guideway, in each case one of the slots being able to be closed by a valve means 11. With the embodiment according to FIG. 2, the outlet slot 10*a* is closed while the outlet slot 10*b* is open, whereas with the embodiment according to FIG. 3, the outlet slot 10*b* is shown in the open position. Water exits through the outlet slot at a speed of approximately 15 meters per second, said water being fed by a feed pipe 12. The water flowing out of outlet slot 10*b* carries the fabric web 3 along with it, accelerates it, and flings it against a rebound surface 13, by which means the fabric web 3 and the fibers comprising said fabric web 3 are subjected to mechanical loading. The fabric web falls downwards from the rebound surface 13 into a fabric storage chamber 17, out of which storage chamber said web can be transported away by means of transport rollers 14 and 15.

In order to repeatedly subject the fabric web 3 to the treatment described, the valve means can be displaced laterally so that the outlet slots 10*a* or the outlet slots 10*b* are closed off alternatingly. Depending on which outlet slot the liquid exits at high speed, the fabric web 3 will be flung either against rebound surface 13 or rebound surface 16. The alternating flinging imparts a particularly uniform and, for the feel of the fabric, effective mechanical treatment to the fabric web.

FIG. 3 shows an embodiment wherein a guide slot 7 is provided with outlet slots 10*a* and 10*b* both on the upper side and also the under side of the fabric web 3. Accordingly, two valve means 11 are also provided which, with the operating mode shown, close off the outlet slots 10*b* so that the liquid is fed to the outlet 10*a* and so that the fabric is transported and accelerated in the direction of the arrow x.

FIG. 4 shows a detail view onto the guide slot 7 according to FIG. 3 through which the fabric web is transported by means of the water, said water being delivered at high speed. The outlet slots 10*a* and 10*b* are, with that, indicated on both sides by means of dotted lines. (As stated in the above, with the embodiment according to FIG. 2 an outlet opening 10*a* is provided only on the lower side of the guide slot 7.)

By means of the number of treatment steps (flinging onto a rebound surface), the control of rebound speed and either one-sided or alternate-sided treatment, the degree of fibrillation can be influenced with the invention, and with that also the surface properties and the feel of the fabric. Prior and/or subsequent enzyme treatment steps can be initiated in order to additionally influence fibrillation.

Mainly in the case of an arrangement according to FIG. 3, wherein outlet slots 10*a* and 10*b* are provided for the liquid not only on the upper side of the guide slot 7 but also on the lower side of the guide slot 7, not only "open-width" fabric can be treated, but also tubular fabric, insofar as this is desired. This leads to particularly economic results wherein, surprisingly, a surface treatment occurs on the inside of the tubular fabric also, even though this inside surface does not make direct contact with the rebound surface. The treatment generally comprises three components: (1) fabric-rebound baffle; (2) fabric-water; (3) fabric-fabric.

The force at which the wet fabric is flung against the rebound surfaces obviously depends not only on the speed of the transport liquid but also the length of the acceleration distance, as well as on sundry braking actions and the mass of the wet fabric at the moment of rebound. Typically, on rebound, forces in the region of 2.5 to 9 Newton per cm occur per cm of fabric width. Preferably, the values lie between 5 and 9 Newton per cm. This leads to particularly favorable fibrillation results.

The invention is particularly effective for use with weaves which comprise 100% fibrillatable cellulose fibers such as lyocell fibers (in particular tencel fibers). It is also possible, however, to treat fabric comprising mixed fibers or mixed weaves.

Inasmuch as the invention is subject to modifications and variations, the foregoing description and accompanying drawings should not be regarded as limiting the invention, which is defined by the following claims and various combinations thereof:

I claim:

1. Method of fibrillating cellulose fibers contained in a textile fabric web (3), said method comprising steps of passing the fabric web through a first storage chamber (6), accelerating the fabric web in a first direction by means of a high speed fluid toward a first rebound surface so that the accelerated fabric web is flung against the rebound surface (13, 16) by said flow of liquid, feeding the fabric web (3) from the first rebound surface (13) to a second fabric storage chamber (17), temporarily storing the fabric web in said second storage chamber, withdrawing the fabric web from the second fabric storage chamber (17) by means of a liquid flowing in a second direction opposite the first direction and transporting the fabric web back toward the first fabric storage chamber (6), accelerating the fabric web (3) by the flow of liquid flowing at high speed and flinging the fabric web against a second rebound surface (16) en route to said first storage chamber, and repeating the above sequence of steps until the surface area of the fibers is split and fibrils form.

2. Method according to claim 1, further comprising steps of collecting the fabric web in said first fabric storage chamber (6) prior to feeding the fabric web into contact with the flow of liquid.

3. Method according to claim 1, further comprising transporting the fabric web to and fro by an alternating flow of liquid between both fabric storage chambers (6, 17) and in each case flinging the fabric web against a respective rebound surface (13, 16).

4. Method according to claim 3, comprising a further step of continuously feeding additional fabric into the first fabric storage chamber while continuously transporting fabric away from the second fabric storage chamber, and wherein, during each step of transporting the fabric web to and fro between the first and second fabric storage chambers, a greater length of fabric web is fed toward the second fabric storage chamber than is fed back to the first storage chamber.

5. Method according to claim 1, wherein the fabric web is accelerated to a speed of at least 8 meters per second.

* * * * *